US006446809B2

(12) United States Patent
Flynn

(10) Patent No.: US 6,446,809 B2
(45) Date of Patent: Sep. 10, 2002

(54) RIGID LIGHTWEIGHT CARRYING CASE

(75) Inventor: Timothy R. Flynn, Elkhorn, WI (US)

(73) Assignee: GWW, Inc., Elkhorn, WI (US)

( * ) Notice: Subject to any disclaimer, the term of this patent is extended or adjusted under 35 U.S.C. 154(b) by 0 days.

(21) Appl. No.: 09/776,027

(22) Filed: Feb. 2, 2001

(51) Int. Cl.[7] ..... B65D 85/30; A45C 13/00
(52) U.S. Cl. ..... 206/523; 190/125; 206/314
(58) Field of Search ..... 206/14, 314, 523; 190/110, 111, 124, 125

(56) References Cited

U.S. PATENT DOCUMENTS

| | | | | | |
|---|---|---|---|---|---|
| 2,706,036 | A | * | 4/1955 | Neal | 206/523 |
| 3,181,693 | A | | 5/1965 | Freistat | |
| 3,520,769 | A | | 7/1970 | Baker | |
| 3,596,754 | A | | 8/1971 | Peterson | |
| 3,901,384 | A | | 8/1975 | Lee et al. | |
| 4,911,962 | A | | 3/1990 | Baumann et al. | |
| 5,219,075 | A | | 6/1993 | White | |
| 5,555,671 | A | | 9/1996 | Voight et al. | |
| 5,669,495 | A | | 9/1997 | West | |
| 5,713,465 | A | | 2/1998 | Choe | |
| 5,816,395 | A | | 10/1998 | Dougherty | |
| 6,029,804 | A | * | 2/2000 | Flynn | 206/14 |

* cited by examiner

*Primary Examiner*—Bryon P. Gehman
(74) *Attorney, Agent, or Firm*—Brown & Michaels, PC

(57) ABSTRACT

A rigid lightweight carrying case includes first and second frame members hingedly attached to one another, each comprising a band of rigid material substantially defining the outline of the carrying case, and at least partially circumscribing the object to be carried in the case, a layer of rigid foam material affixed within each frame member located towards the exterior of the case a layer of soft foam material affixed within each frame member adjacent the rigid foam material and located towards the interior of the case, the soft foam providing support for an object to be carried in the case, an inner fabric layer of plush material on the interior of the case covering substantially the soft foam material, an outer fabric layer affixed to the exterior of the case covering substantially the rigid frame members and rigid foam material, and a carrying handle.

16 Claims, 3 Drawing Sheets

RIGID LIGHTWEIGHT CARRYING CASE

BACKGROUND OF THE INVENTION

1. Field of the Invention

The invention relates generally to carrying cases, and in particular, to a lightweight rigid carrying case that includes a molded foam construction.

2. Description of Related Art

Musical instrument carrying cases of the prior art are typically of two main types. They are either made of wood, metal, plastic or other similarly rigid materials, or alternatively consist of soft-side bag-style cases, typically referred to as a "gig bag". For example, hard-shell rigid carrying cases are disclosed in U.S. Pat. Nos. 3,181,693; 3,596,754; 3,901,384; 5,219,075; 5,713,465; 5,816395; and 6,029,804.

While prior art musical instrument carrying cases that are formed from rigid materials tend to be very strong and durable, providing excellent protection of the musical instrument, such cases also tend to be rather heavy and cumbersome. On the other hand, the soft-side bag-style cases, or "gig bags" tend to be more lightweight, yet they typically provide significantly less protection of the musical instrument contained therein, compared to rigid cases. Thus, there exists a need for a musical instrument carrying case that combines the desirable features of both hard and soft carrying cases of the prior art, thereby providing a carrying case that is both strong and durable, yet relatively lightweight.

SUMMARY OF THE INVENTION

Briefly stated, a rigid lightweight carrying case includes first and second frame members hingedly attached to one another, each comprising a band of rigid material substantially defining the outline of the carrying case and at least partially circumscribing the object to be carried in the case, a layer of rigid foam material affixed within each frame member and located towards the exterior of the case for providing structural rigidity to the case, a layer of soft foam material affixed within each frame member adjacent the rigid foam material and located towards the interior of the case, the soft foam being contoured to accommodate and provide support for an object to be carried in the case, an inner fabric layer of plush material on the interior of the case covering substantially the soft foam material, an outer fabric layer affixed to the exterior of the case covering substantially the rigid frame members and the rigid foam material, and means for carrying the case attached thereto, thus providing a carrying case that is both strong and durable, yet lightweight.

DETAILED DESCRIPTION OF THE INVENTION

Figure 1:
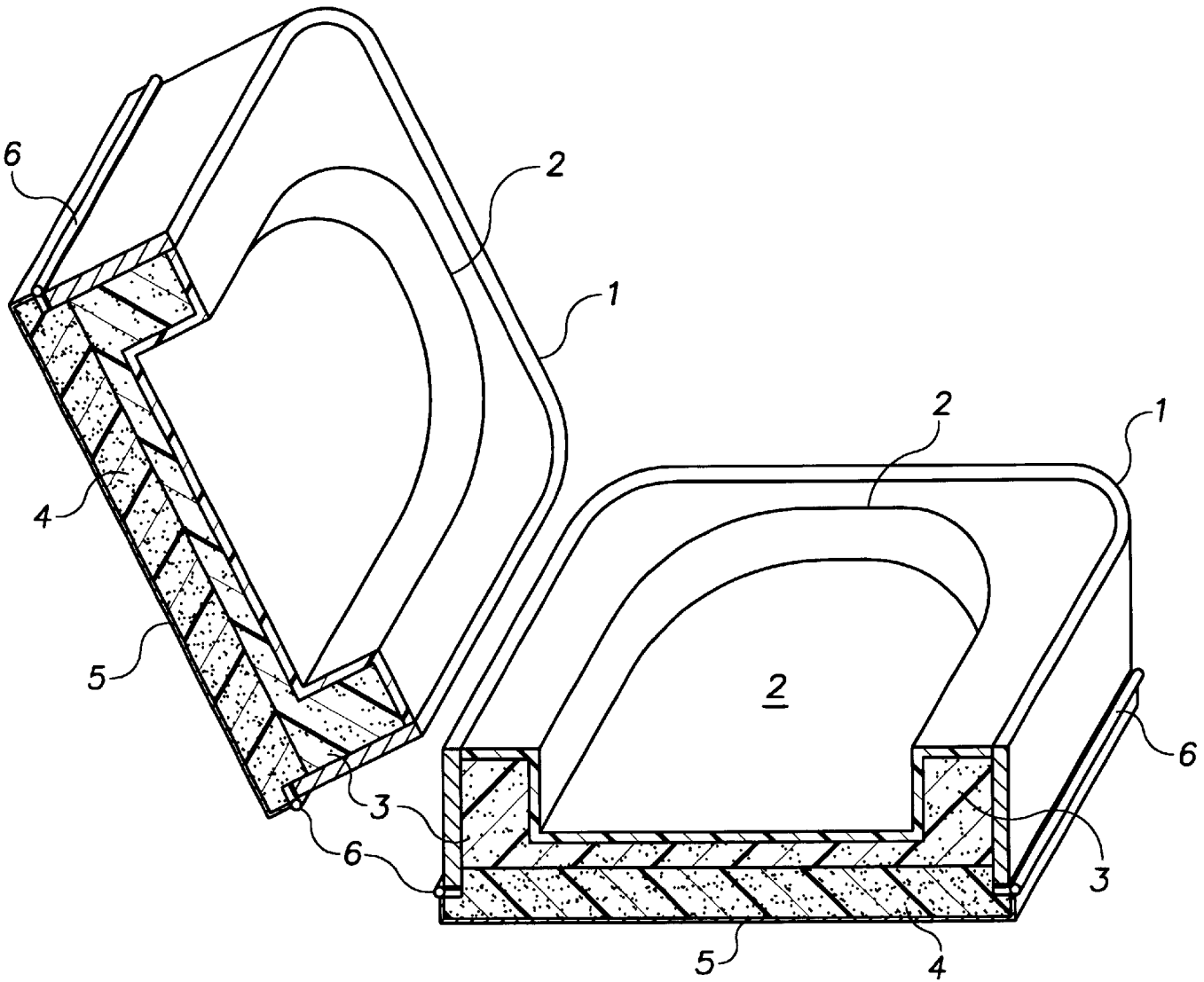
FIG. 1 shows a cross-section view of a carrying case, according to an embodiment of the invention.

The carrying case of the present invention is suitable for carrying virtually any item, including but not limited to musical instruments, electronic equipment, laptops and other computers, video and still photography cameras and equipment, etc. The carrying case of the invention is constructed primarily from foam materials of various densities, rather than being made of wood, metal, plastic, fiberglass or other similar rigid materials, as is typically found of hard-shell carrying cases. The case of the present invention thus provides the strength and rigidity of a typical hard-shell case, thereby providing ample protection for the object to be carried, on both the inside and outside of the case, while also being relatively lightweight in comparison to prior art hard-shell cases. Thus, the invention combines the most desirable features of the hard-shell and soft-side carrying cases of the prior art.

The invention employs a rigid material, such as, for example, wood, metal, plastic, fiberglass or any other similar rigid material, suitable to provide a frame for the carrying case, thereby giving shape and adequate structural strength and rigidity to the case. The frame defines the general outline of the plan view of the carrying case, and at least partially circumscribes the object to be carried therein, as shown in the drawing. The frame members do not have any lids on them. Indeed, the carrying case of the present invention does not have a typical lid, as in the prior art, rather, the lid is integral with the case itself, in that there is a separate frame for the bottom half and the top half of the case. Attached to one opening of each frame member is a piece of material, attached by any variety of methods, such as, for example, staples, glue, sewing, rivets, or any other suitable means. Thus, the portion of the invention that would serve as a lid is preferably not made from a rigid material, but rather is made from a fabric or other flexible, lightweight durable material, such as, for example, Cordura™. By eliminating the lids of typical hard-shell cases, significant weight reduction is realized, yet the protection of a hard-shell case remains.

In typical soft-side cases, zippers are normally used as a closing means, which can easily break, thereby rendering the rendering the case essentially useless. In the present invention, instead of using zippers, hardware items, such as hinges, hasps, drawbolts, latches, locks, handles, etc., are preferably used and permanently attached to the frame of the case using standard fastening means, which are well known in the art. The bottom and top frame members are preferably joined using hinges and hasps, drawbolts or latches, and/or locks, with which one skilled in the art of hard-shell carrying cases is quite familiar.

One or more inserts comprising molded foam or a similar lightweight material are fitted snugly within the inside of the frame members to hold the object to be carried, and further to provide additional structural support to the frame. The insert, which protects the object to be carried, also fills out the flexible lid of the case, again providing additional structural support for the carrying case of the present invention. The insert is contoured to match the shape of the instrument and the frame member, and also provides support at the open end of the frame, to which the fabric is attached.

Referring now to FIG. 1, a cross-section of a lightweight rigid molded foam carrying case of the invention is shown. The exterior of the lightweight molded foam carrying case of the present invention is constructed from a combination of a frame member 1 and a rigid foam material 4 to provide shape and structure, while the interior is constructed from a soft foam material 3 contoured to the shape of the object to be carried, to support the object. The inner soft foam layer is soft enough to also allow instruments of slightly different sizes to fit and be protected. The case has a wooden frame 1 and an outer fabric layer (not shown) on the exterior of the case. The wooden frame 1 provides additional structural rigidity, while the outer fabric layer (not shown) is a highly durable material, such as, for example Cordura™, thereby providing long wear and resistance to abrasion.

The invention is constructed primarily from multiple layers of foam materials of different densities, such that the outer layer is a rigid layer of foam material 4 which is relatively more dense, thus resembling the outer shell of prior art hard-shell cases, while the inner layer is a soft layer of foam material 3, which is relatively less dense, thus providing a soft cushion upon which to nest and support the object to be carried. Covering the inner layer of soft foam 3 is an inner fabric layer of plush material 2, such as, for example, velveteen, to prevent scratching or otherwise marking of the object to be carried. The inner fabric layer of plush material 2 optionally is laminated to a waterproof barrier material (not shown), such as, for example, plastic film, such that the soft layer of foam 3, when in a liquid state, as in during construction thereof, does not penetrate the inner fabric layer of plush material 2. The case also includes traditional style hinge, latch and optional locking hardware (not shown), which are typically constructed of metal, and a carrying handle, constructed from any suitable material.

Figure 2:
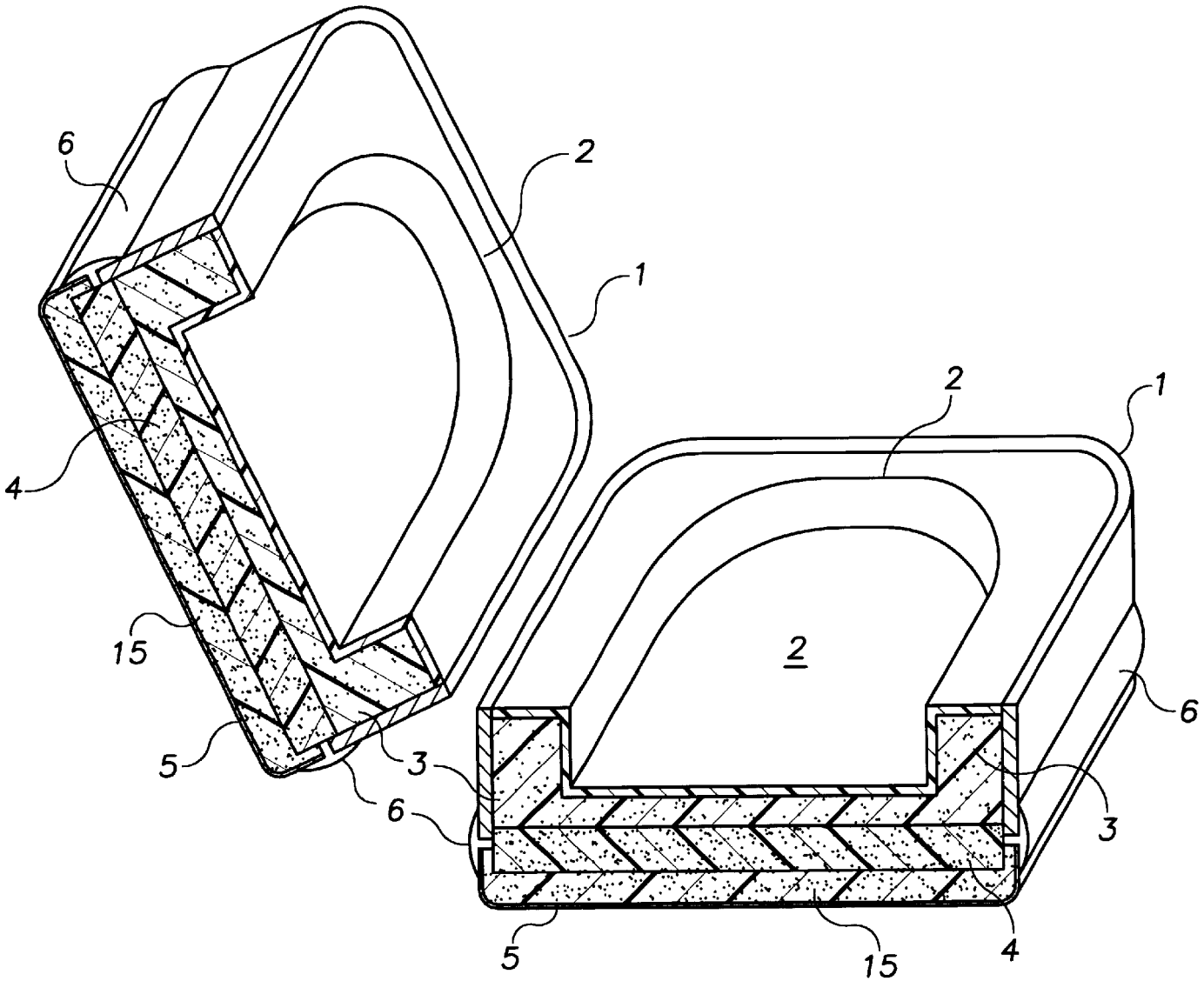
FIG. 2 shows a cross-section view of a carrying case, according to an alternate embodiment of the invention having additional features.
Figure 3:
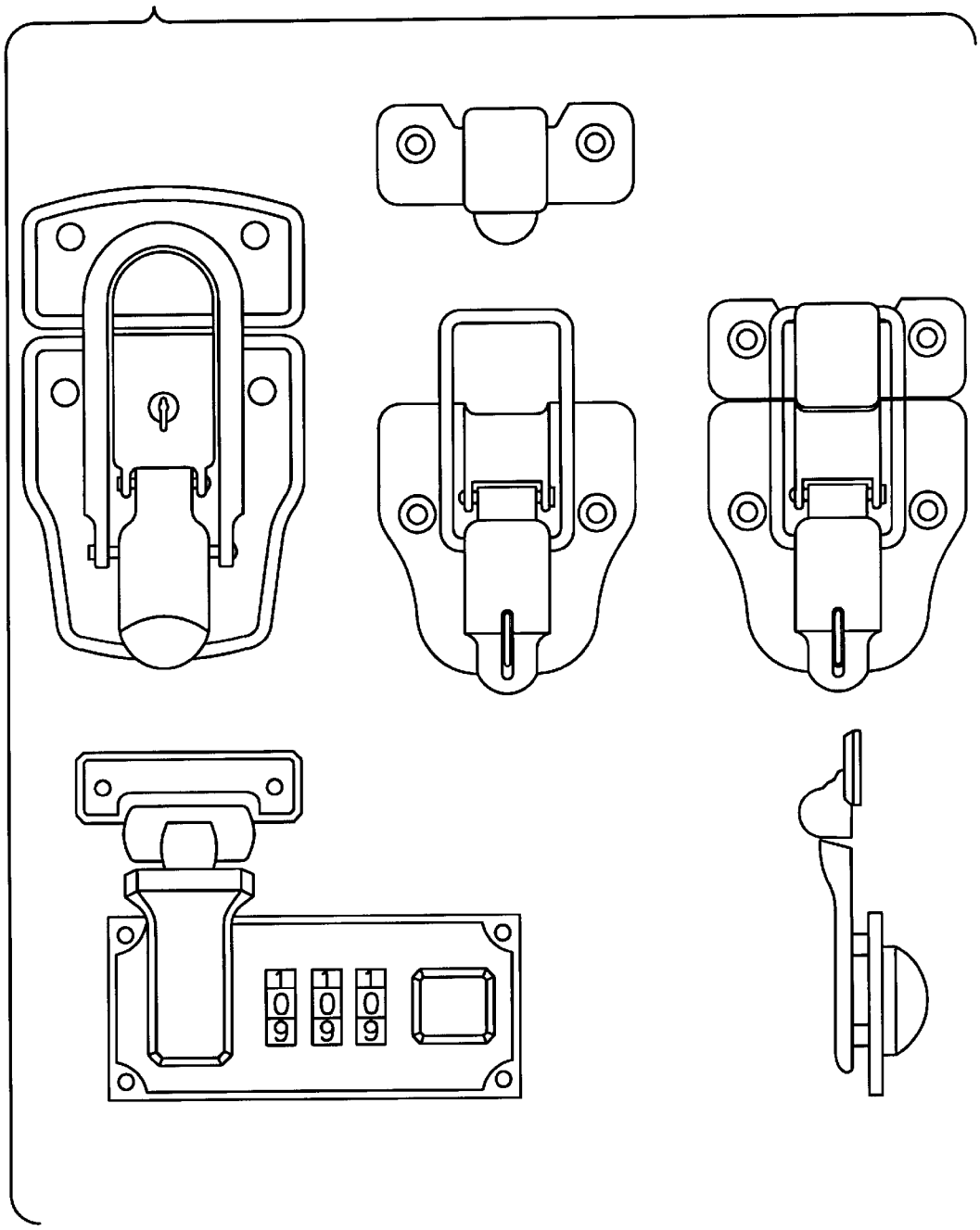
FIG. 3 shows a view of several examples of closing means for a carrying case, according to an embodiment of the invention.

Referring now to FIG. 2, optionally, the case may include an additional layer of foam material 15, such as, for example, an additional layer of polyurethane foam between the outer fabric layer and the surface of the rigid foam layer 4, such that this additional foam layer 15 provides another layer of protection and fills out any voids or spaces that may form between the outer fabric layer (not shown) and the surface of the rigid layer of foam 4. FIG. 3 shows a view of several examples of closing means for the carrying case.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A rigid lightweight carrying case, comprising:

a) first and second frame members hingedly attached to one another, each comprising a band of rigid material substantially defining an outline of said carrying case and at least partially circumscribing an object to be carried in said case;

b) a layer of rigid foam material affixed within each frame member and located towards an exterior of said case for providing structural rigidity to said case;

c) a layer of soft foam material affixed within each frame member adjacent said rigid foam material and located towards an interior of said case, said soft foam being contoured to accommodate and provide support for an object to be carried in said case;

d) an inner fabric layer of plush material on an interior of said case covering substantially said soft foam material;

e) an outer fabric layer affixed to an exterior of said case covering substantially said rigid frame members and said rigid foam material; and f) means for carrying said case attached thereto.

2. The carrying case of claim 1, further comprising an additional layer of foam material located between said outer fabric layer and said layer of rigid foam material.

3. The carrying case of claim 1, wherein said rigid frame comprises a material selected from the group consisting of wood, metal, fiberglass, plastic and any other suitable rigid material.

4. The carrying case of claim 1, wherein said inner fabric layer of plush material is molded to said soft foam layer.

5. The carrying case of claim 1, wherein said outer fabric layer comprises a durable fabric.

6. The carrying case of claim 1, further comprising an extruded plastic binding, to which said outer fabric layer is attached.

7. The carrying case of claim 1, further comprising closing means selected from the group consisting of hinges, hasps, drawbolts, latches and locks.

8. The carrying case of claim 1, wherein said case does not include a zipper as a closing means.

9. A rigid lightweight carrying case, comprising:

a) first and second frame members hingedly attached to one another, each comprising a band of rigid material substantially defining an outline of said carrying case and at least partially circumscribing an object to be carried in said case;

b) a layer of rigid foam material affixed within each frame member and located towards an exterior of said case for providing structural rigidity to said case;

c) a layer of soft foam material affixed within each frame member adjacent said rigid foam material and located towards an interior of said case, said soft foam being contoured to accommodate and provide support for an object to be carried in said case;

d) an inner fabric layer of plush material on an interior of said case covering substantially said soft foam material, wherein said inner fabric layer of plush material is laminated to a waterproof barrier, such that said soft layer of foam material, when in a liquid state, does not penetrate said inner fabric layer of plush material;

e) an outer fabric layer affixed to an exterior of said case covering substantially said rigid frame members and said rigid foam material; and f) means for carrying said case attached thereto.

10. The carrying case of claim 9, further comprising an additional layer of foam material located between said outer fabric layer and said layer of rigid foam material.

11. The carrying case of claim 9, wherein said band of rigid material comprises a material selected from the group consisting of wood, metal, fiberglass, plastic and any other suitable rigid material.

12. The carrying case of claim 9, wherein said inner fabric layer of plush material is molded to said soft foam layer.

13. The carrying case of claim 9, wherein said outer fabric layer comprises a durable fabric.

14. The carrying case of claim 9, further comprising an extruded plastic binding, to which said outer fabric layer is attached.

15. The carrying case of claim 9, further comprising closing means selected from the group consisting of hinges, hasps, drawbolts, latches and locks.

16. The carrying case of claim 9, wherein said case does not include a zipper as a closing means.

* * * * *